US010212969B2

(12) United States Patent
Lemay et al.

(10) Patent No.: US 10,212,969 B2
(45) Date of Patent: Feb. 26, 2019

(54) METHOD AND MACHINE FOR MAKING ELECTRONIC CIGARETTE CARTRIDGES

(71) Applicant: G.D S.p.A., Bologna (IT)

(72) Inventors: Michael Andre Lemay, Bologna (IT); Mark Roland Godon, Bologna (IT); Stefano Negrini, Calderara di Reno (IT)

(73) Assignee: G.D S.p.A., Bologna (IT)

( * ) Notice: Subject to any disclaimer, the term of this patent is extended or adjusted under 35 U.S.C. 154(b) by 128 days.

(21) Appl. No.: 15/116,465

(22) PCT Filed: Mar. 12, 2015

(86) PCT No.: PCT/IB2015/051819
§ 371 (c)(1),
(2) Date: Aug. 3, 2016

(87) PCT Pub. No.: WO2015/140677
PCT Pub. Date: Sep. 24, 2015

(65) Prior Publication Data

US 2017/0006921 A1 Jan. 12, 2017

(30) Foreign Application Priority Data

Mar. 21, 2014 (IT) ..... BO2014A0150

(51) Int. Cl.
*H05K 3/30* (2006.01)
*A24F 47/00* (2006.01)

(52) U.S. Cl.
CPC ..... *A24F 47/008* (2013.01)

(58) Field of Classification Search
CPC ..... A24F 47/008; H01R 43/26; A61M 15/06; B23P 11/005; B23P 19/04
See application file for complete search history.

(56) References Cited

U.S. PATENT DOCUMENTS 9,027,566 B2 * 5/2015 Garrett ..... A24D 3/0233 131/332
9,138,017 B2 * 9/2015 Garrett ..... A24D 3/0233
(Continued)

FOREIGN PATENT DOCUMENTS

EP 2113177 A1 11/2009
KR 20120070731 A 7/2012
(Continued)

OTHER PUBLICATIONS

International Search Report and Written Opinion dated Jun. 12, 2015 for counterpart PCT Application No. PCT/IB2015/051819.

*Primary Examiner* — Paul D Kim
(74) *Attorney, Agent, or Firm* — Shuttleworth & Ingersoll, PLC; Timothy Klima

(57) ABSTRACT

A method for making electronic cigarette cartridges. The method includes a step of making the cartridges along a dedicated production line. The step of making the cartridges includes a step of making a casing by assembling one or more components along a first stretch of the production line and a step of making an electric module by assembling one or more electronic elements along a second stretch of the production line. The steps of making the casing and the electric module are steps which are synchronized and independent relative to one another. Once the steps of making the casing and the electric module are complete, the method includes a step of assembling the casing with a respective electric module to obtain the finished cartridge along a shared third stretch of the production line.

11 Claims, 3 Drawing Sheets

(56) References Cited

U.S. PATENT DOCUMENTS

| | | | | |
|---|---|---|---|---|
| 9,149,069 | B2 * | 10/2015 | Garrett | A24D 3/0233 |
| 9,179,708 | B2 * | 11/2015 | Garrett | A24D 3/0233 |
| 9,833,019 | B2 * | 12/2017 | Ampolini | A24F 47/008 |
| 9,861,139 | B2 * | 1/2018 | Boldrini | A24F 47/008 |
| 9,862,060 | B2 * | 1/2018 | Boldrini | B23K 31/02 |
| 2013/0220315 | A1 | 8/2013 | Conley et al. | |
| 2015/0068542 | A1 * | 3/2015 | Chang | A24F 47/008 131/328 |
| 2015/0305410 | A1 * | 10/2015 | Liu | A24F 47/008 131/329 |

FOREIGN PATENT DOCUMENTS

| | | | |
|---|---|---|---|
| WO | WO0170054 | A1 | 9/2001 |
| WO | WO2013076750 | A1 | 5/2013 |

* cited by examiner

METHOD AND MACHINE FOR MAKING ELECTRONIC CIGARETTE CARTRIDGES

This application is the National Phase of International Application PCT/IB2015/051819 filed Mar. 12, 2015 which designated the U.S. and that International Application was published under PCT Article 21(2) in English.

This application claims priority to Italian Patent Application No. BO2014A000150 filed Mar. 21, 2014, which application is incorporated by reference herein.

TECHNICAL FIELD

This invention relates to a method and a machine for making electronic cigarette cartridges.

BACKGROUND ART

Generally speaking, the term "cartridge" is used to denote the part of the electronic cigarette containing a flavouring substance and a vaporizer or nebulizer for the flavouring substance.

The cartridge can be connected to a power unit of the electronic cigarette which generates the power used by the vaporizer of the flavouring substance.

Cartridges currently available on the market may be of the disposable type or they may be rechargeable so they can be refilled when the flavouring substance is finished.

At present, electronic cigarette cartridges are made by assembling different structural and electronic components which characterize each manufacturer's product.

The on-going expansion of the electronic cigarette market is reflected in the ever increasing number of cartridges to be made and marketed.

There is therefore a need for electronic cigarette cartridge making machines with a greater production capacity than prior art machines and, more specifically, which are capable of considerably increasing the hourly production rate compared to what is currently known.

DISCLOSURE OF THE INVENTION

In this context, one aspect of this invention is the provision of a method which comprises a step of making the cartridges along a dedicated production line. The step of making the cartridges comprises a step of making a casing by assembling one or more components along a first stretch of the production line and a step of making an electric module by assembling one or more electronic elements along a second stretch of the production line. The steps of making the casing and the electric module are steps which are synchronized and independent relative to one another. Once the steps of making the casing and the electric module are complete, the method comprises a step of assembling the casing with a respective electric module to obtain the finished cartridge along a shared third stretch of the production line.

Advantageously, the cartridge casing and the electric module are made in synchronized and independent manner so that the assembly time periods of the casing do not overlap the assembly time periods of the electric module, while at the same time guaranteeing continuous assembly of each casing with a respective electric module and thereby increasing the production capacity of the machine.

BRIEF DESCRIPTION OF THE DRAWINGS

The invention is described below with reference to the accompanying drawings, which illustrate a non-limiting embodiment of it, and in which.

DETAILED DESCRIPTION OF PREFERRED EMBODIMENTS OF THE INVENTION

Figure 1:
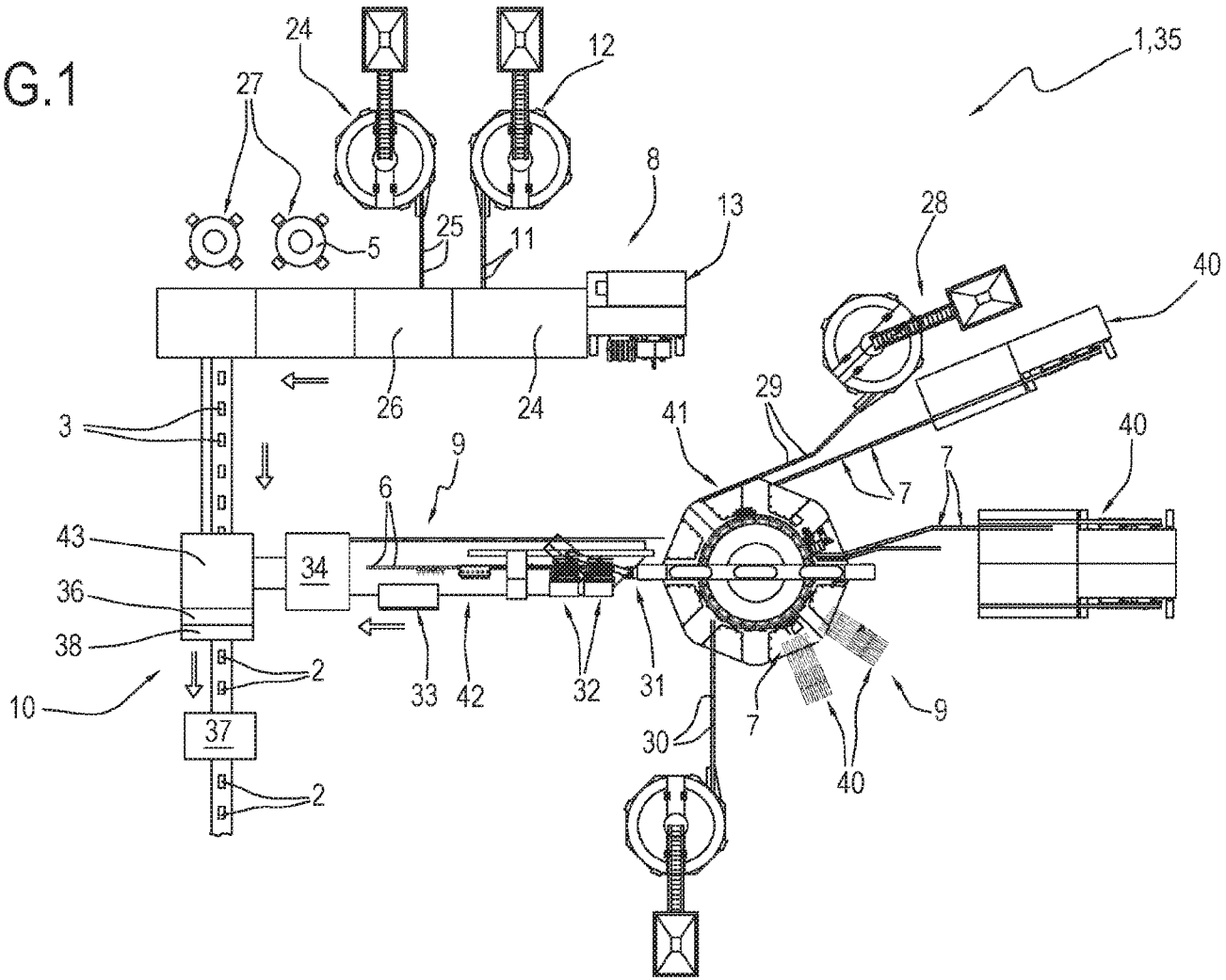
FIG. 1 is a schematic plan view of a machine for making electronic cigarette cartridges according to this invention.

The reference numeral 1 denotes a machine for making electronic cigarette cartridges.

The cartridges 2 comprise a casing 3 which houses at least one component 4 for retaining and containing a flavouring substance 5 and an electric (or electronic) module 6 which is at least partly positioned in the casing 3.

The electric module 6 comprises one or more electronic elements 7 configured to heat the retaining and containing component 4. More specifically, the electric module 6 is configured to vaporize or nebulize the flavouring substance 5.

The casing 3 comprises a shell 11 for housing the retaining and containing component 4.

Preferably, the shell 11 is cylindrical in shape.

More specifically, the shell 11 is hollow so that it can house the retaining and containing component 4.

The machine comprises a production line 35 along which the cartridges 2 are made.

The production line 35 comprises a first stretch 8 along which the casing 3 is made by assembling one or more components 4, 11, 25.

The production line 35 comprises a second stretch 9 along which the electric module 6 is made by assembling one or more electronic elements 7.

The first and second stretches 8, 9 of the production line 35 are synchronized and independent of one another.

That means the production of the casings 3 along the first stretch 8 of the production line 35 does not interfere with the production of the electric modules 6 along the second stretch 9 of the production line 35. The production steps along the first and second stretches 8, 9 are synchronized in such a way that each casing 3 corresponds to an electric module 6 to be assembled continuously without creating intermediate stores or buffers of casings 3 or electric modules 6.

In other words, the production line 35 works continuously without the help of intermediate storage units downstream of the first and second stretches 8, 9.

Downstream of the first and second stretches 8, 9 of the production line 35, the machine 1 comprises a shared third stretch 10 for assembling the casing 3 with a respective electric module 6 in order to make the finished cartridge 2.

The shared third stretch 10 connects the first stretch 8 and the second stretch 9 of the production line 35.

With reference to its first stretch 8, the production line 35 comprises a device 12 for feeding the shell 11 and a device 13 for feeding the component 4 for retaining and containing the flavouring substance 5.

The shells 11 are fed by the device 12 at a respective feed station 21.

The retaining and containing components 4 are fed by the device 13 at a station 22 for feeding the components 4.

In this embodiment, the retaining and containing component 4 is in the form of pieces of tape of fibrous material.

A tape 4*a* of fibrous material is inserted into the feed device 13 and divided into pieces 4 by a cutting unit, not illustrated.

A conveyor 14 receives the shells 11 and the retaining and containing components 4 from the devices 12 and 13, respectively.

The conveyor 14 has a station 23 for feeding out the shells 11 which house the respective retaining and containing components 4.

In other words, the conveyor 14 defines a means for assembling the shells 11 with the respective retaining and containing components 4.

The conveyor 14 comprises a drum 15 which rotates about its axis of rotation 14*a*.

The drum 15 comprises a plurality of flutes 16 for receiving respective shells 11.

The flutes 16 are distributed along the peripheral surface of the drum 15.

Preferably, the flutes 16 are equispaced from each other.

The conveyor 14 comprises a means 17 for supporting elements 18 by which the retaining and containing elements 4 are inserted into the respective shells 11.

The supporting means 17 is positioned in front of the drum 15 and, more specifically, each inserting element 18 is aligned with a respective flute 16 of the drum 15 positioned in front of it.

The supporting means 17 rotates about the axis of rotation 14*a* of the drum 15.

More specifically, the drum 15 and the supporting means 17 rotate about the axis of rotation 14*a* at the same angular speed.

Each inserting element 18 comprises a shaft 19 and a cylinder 20 for receiving the shaft 19.

The shaft 19 is free to move translationally inside the cylinder 20 towards and away from the respective flute 16 which receives the shell 11 on the drum 15.

The shaft 19 rotates about its axis of rotation 19*a*.

The axes of rotation 19*a* of the shafts 19 are parallel to the axis of rotation 14*a* of the drum 15.

The cylinder 20 which receives the shaft 19 of each inserting element 18 is movable towards and away from the flute 16 which receives the shell 11 on the drum 15.

Cam means, not illustrated, move the shaft 19 and the cylinder 20 towards and away from the respective flute 16 which receives the shell 11 on the drum 15.

In use, as the drum 15 and the supporting means 17 rotate, the flutes 16 on the drum 15 receive the shells 11 from the feed device 12 at the feed station 21.

Figure 2:
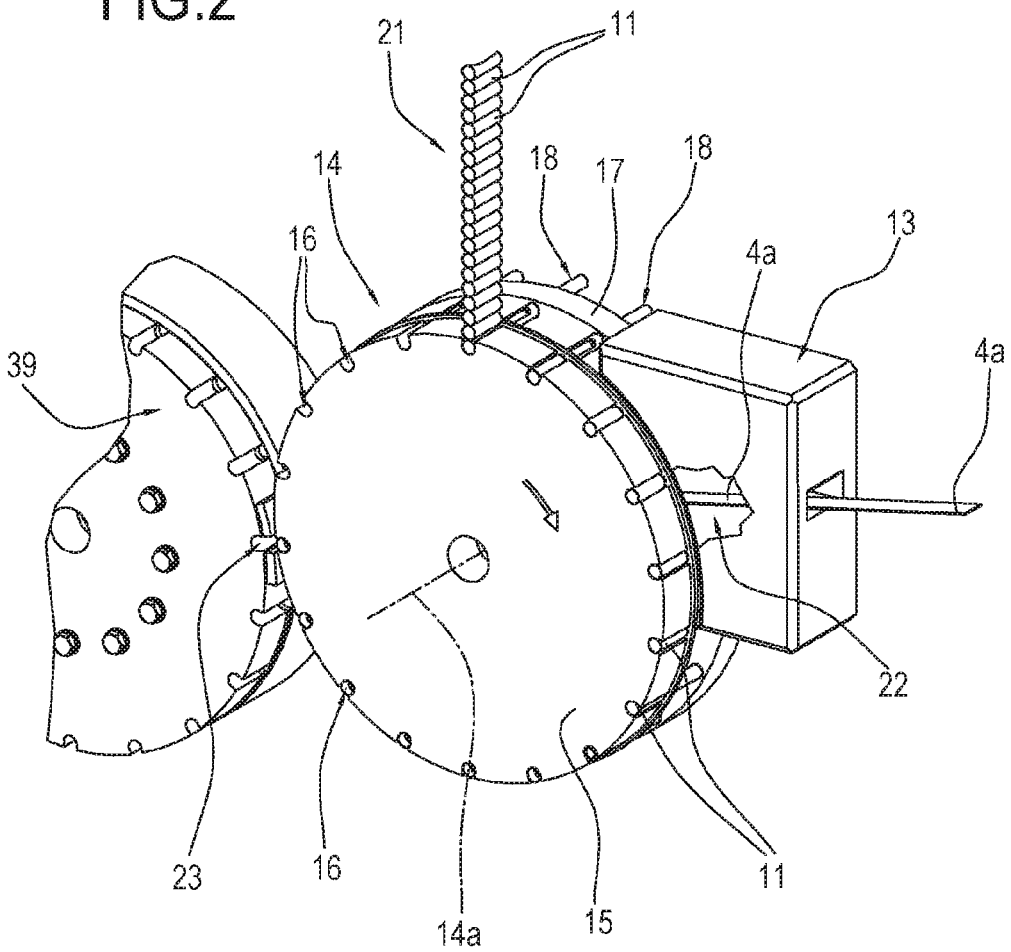
FIG. 2 shows a conveyor of the machine of FIG. 1.

As illustrated in FIG. 2, the station 22 for feeding the retaining and containing components 4 is located, in the direction of rotation of the conveyor 14, downstream of the station 21 for feeding the shells 11.

More specifically, at the feed station 22, the tape 4 of fibrous material is fed to a shaft 19 of a respective inserting element 18.

The rotation of the shaft 19 about its axis 19*a* causes the tape 4 of fibrous material to be rolled up around the peripheral surface of the shaft 19 itself.

The cutting unit, not illustrated, cuts the tape 4 of fibrous material rolled up around the shaft 19, thus defining the piece 4 of fibrous material.

From the station 22 for feeding the retaining and containing component 4 to the outfeed station 23, the rolled-up piece 4 of fibrous material is inserted into the respective shell 11 by the inserting element 18.

Figure 3:
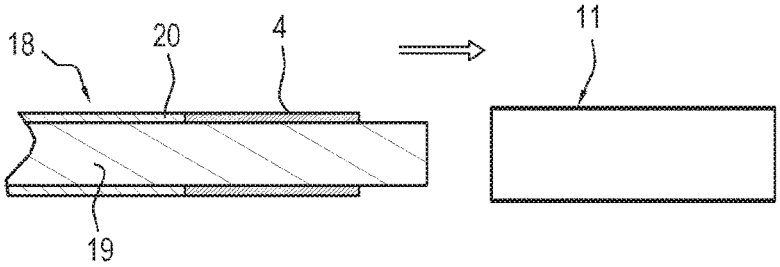
FIGS. 3 to 7 schematically illustrate a sequence of production steps carried out by the conveyor illustrated in FIG. 2.

More specifically, the shaft 19 and the respective cylinder 20 of each inserting element 18 both move translationally towards the shell 11 housed in the flute 16 on the drum 15 positioned in front of it, as illustrated in FIG. 3.

Figure 4:
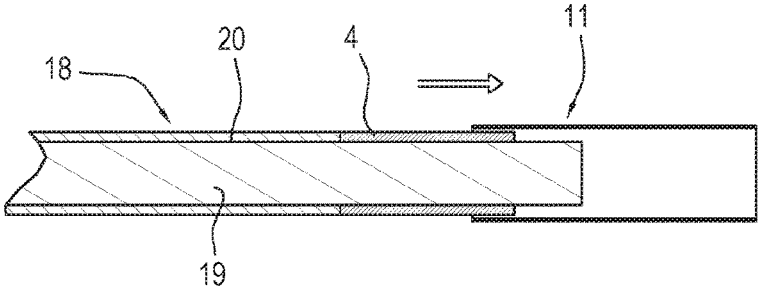

The shaft 19 and the respective cylinder 20 continue to move translationally until the cylinder 20 and the shaft 19 supporting the piece 4 of fibrous material are both inserted, at least partly, into the shell 11, as illustrated in FIG. 4.

Figure 5:
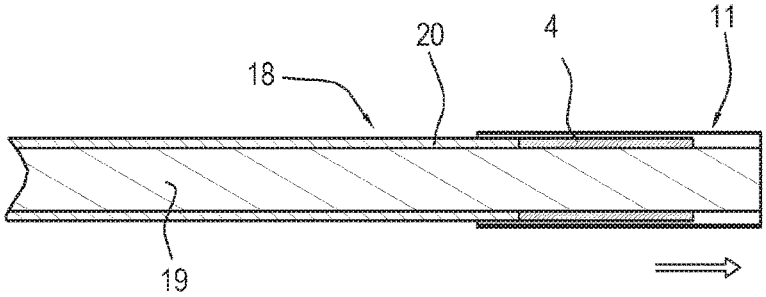

At this point, the cylinder 20 stops, while the shaft 19 continues moving, preferably until it reaches the far end of the shell 11, as illustrated in FIG. 5.

Figure 6:
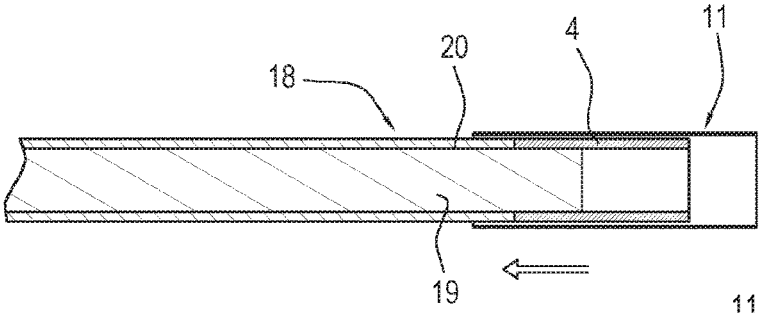

In order to release the piece 4 inside the shell 11, the shaft 19 starts backing up relative to the shell 11 located in the flute 16 on the drum 15, whilst the cylinder 20 remains stationary, as illustrated in FIG. 6.

Figure 7:
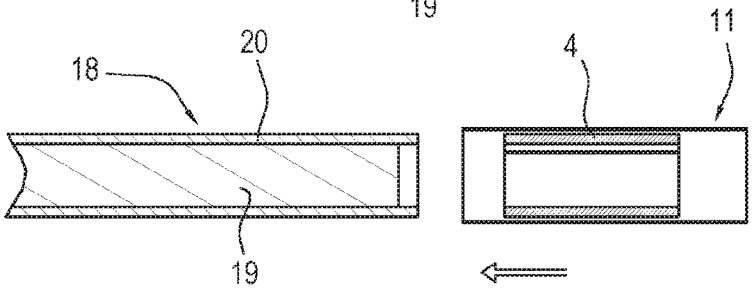

Advantageously, the cylinder 20 stops the piece 4 of fibrous material from coming out of the shell 11 and allows the shaft 19 to be pulled out of the piece 4 rolled up around it, as illustrated in FIG. 7.

Once the shaft 19 has been pulled out, the cylinder 20 starts moving translationally away from the shell 11 until it is extracted completely.

At the outfeed station 23, the pick-up means 39 receives from the conveyor 14 the shells 11 housing the respective retaining and containing elements 4.

The first stretch 8 of the production line comprises a device 24 for feeding elements 25 used to close one end of the shells 11.

Downstream of the means 14 for assembling the shells 11 with the respective retaining and containing components 4, the first stretch 8 comprises a means 26 for assembling each closing element 15 with the respective shell 11 housing the respective retaining and containing component 4.

Preferably, downstream of the means 26 for assembling each closing element 15 with the respective shell 11, the first stretch 8 comprises means 27 for filling the flavouring substance 5.

In the embodiment described, the rolled-up piece 4 of fibrous material located inside the shell 11 is soaked with and retains the flavouring substance 5.

Each shell 11, closed by the respective closing element 15 and housing the respective component 4 for retaining and containing the flavouring substance 5, defines the casing 3 of the cartridge 2.

The casing 3 is then conveyed from the first stretch 8 of the production line 35 to the shared third assembly stretch 10.

With reference to its second stretch 9, the production line 35 comprises a device 28 for feeding basic components 29.

The feed device 28 comprises orienting means, not illustrated, by which the basic components 29 are oriented according to a predetermined configuration.

Downstream of the orienting means, not illustrated, the feed device 28 comprises means, not illustrated, for checking the orientation of the basic components 29.

If the basic components 29 are not oriented according to the predetermined configuration, the checking means, not illustrated, reject the basic components 29 and the latter are again fed to the orienting means, not illustrated.

Downstream of the means 28 for feeding the basic components 29, the second stretch 9 comprises means 40 for feeding respective electronic elements 7.

The electronic elements 7 define an electrical resistance capable of vaporizing or nebulizing the flavouring substance 5.

For example, the electronic elements 7 may comprise terminals made of a metallic material capable of transferring heat to the retaining and containing components 4.

A spacer made of insulating material, such as ceramic, for example, can be interposed between the terminals.

The terminal spacer constitutes an accessory component 30 of the electric module 6.

The electric module 6 may comprise one or more accessory components 30 configured to improve the operation of the electric module 6.

In order to check for vaporizing of the flavouring substance 5 or for the presence of the flavouring substance, the electronic elements 7 may further comprise a printed circuit powered through a respective power supply pin.

The accessory components 30 are assembled with respective electronic components 7 of the electric module 6 along the second stretch 9.

The electronic elements 7 are mounted on the basic component 29 according to predetermined mutual positions.

In order to arrange the electronic elements 7 and the accessory components 30 according to a predetermined configuration, the second stretch 9 of the production line preferably comprises means, not illustrated, for orienting the electronic elements 7 of the electric module 6 and/or the accessory components 30.

It should be noted that the devices 28 for feeding the electronic elements 7 are positioned along the second stretch 9 according to a predetermined assembly sequence.

In the embodiment illustrated, the second stretch 9 of the production line has a first section 41 which is configured like a carousel and a second section 42 which is substantially rectilinear.

A transfer and spacing variation device 31 picks up the basic component 29 with one or more electronic elements 7 and/or with one or more accessory components 30 assembled by the first section 41 and transfers them to the second section 42 along which the assembly of the electronic elements 7 and/or of accessory components 30 is completed.

More specifically, the second section of the second stretch 9 comprises a device 32 for feeding a wick of fibrous material with a filament of conductive material defining a further electronic element 7 wound around it.

The wick with the filament wound around it is cut into pieces by a cutting unit, not illustrated, and is associated with the aforementioned terminals.

The second stretch 9 comprises a soldering station 33 (also called wiring station) for soldering one or more electronic elements 7 to each other, and more specifically, for soldering the filament wound around the wick of fibrous material to the terminals assembled on the basic component 29.

Once assembly of the electronic elements 7 and of the accessory components 30, if any, has been completed along the second stretch 9, the electric module 6 is finished.

The second stretch 9 comprises one or more inspecting stations 34 for checking that the electric modules 6 have been assembled correctly and rejecting any electric modules 6 considered defective.

The electric module 6 is conveyed from the second stretch 9 to the shared third assembly stretch 10, preferably downstream of the inspecting stations 34.

In an embodiment not illustrated, the production line 9 has a substantially rectilinear section for assembling the electronic elements 7 and/or the accessory components 30.

With reference to its shared third assembly stretch 10, the production line 35 comprises a station 43 for inserting the electric module 6 into the respective casing 3.

Downstream of the inserting station 43, the shared third stretch 10 comprises a station 36 for closing the casing 3.

Preferably downstream of the station 36 for closing the casing 3, the shared third stretch 10 comprises a station 38 for applying an adhesive label to the casing 3.

The shared third stretch 10 comprises an inspecting station 37 for checking the finished cartridge 2 to ensure that the finished product conforms to predetermined quality parameters.

The cartridges 2 considered defective at the inspecting station 37 are rejected.

This invention has for an object to provide a method for making electronic cigarette cartridges.

The method comprises a step of making the cartridges 2 along a dedicated production line 35.

The step of making the cartridges 2 comprises a step of making the casing 3 by assembling one or more components 4, 11, 25 along a first stretch 8 of the production line 35 and a step of making the electric module 6 by assembling at least one or more electronic elements 7 along a second stretch 9 of the production line 35.

The steps of making the casing 3 and the electric module 6 are steps which are synchronized and independent relative to one another.

Once the steps of making the casing 3 and the electric module 6 are complete, the method comprises a step of assembling the casing 3 with a respective electric module 6 to obtain the finished cartridge 2 along a shared third stretch 10 of the production line 35.

The step of making the electric module 6 comprises a step of feeding a basic component 29 along the first stretch 8 of the production line 35 relative to which one or more electronic elements 7 are assembled.

The method comprises a step of orienting the basic component 29 according to a predetermined configuration and a step of checking the orientation of the basic component 29 relative to the predetermined configuration.

The method comprises a step of mounting the electronic elements 7 of the electric module 6 on the basic component 29 according to predetermined mutual positions.

The method comprises a step of feeding at least one accessory component 30 of the electric module 6 along the second stretch 9 of the feed line 35 and a step of assembling the accessory component 30 with at least one respective electronic element 7 of the electric module 6.

The method comprises a step of orienting one or more of the electronic elements 7 of the electric module 6 and/or one or more of the accessory components 30 before the respective feed step.

The method comprises one or more steps of wiring at least one electronic element 7 to a further electronic element 7.

The step of making the casing 3 comprises a step of inserting the component 4 for retaining and containing the flavouring substance 5 into a respective containment shell 11.

The step of making the casing 3 comprises a step of assembling the shell 11 with a respective closing element 25.

The step of making the casing 3 comprises a step of filling the retaining and containing component 4 with the flavouring substance 5.

The invention claimed is:

1. A method for making a cartridge for an electronic cigarette, the cartridge comprising a casing housing a retaining and containing component for retaining and containing a flavoring substance and an electric module, at least partly positioned inside the casing, the electric module comprising one or more electronic elements for heating the retaining and containing component;

the method comprising:

making the cartridge along a dedicated production line;

the making the cartridge further comprising:

making the casing by assembling one or more components along a first stretch of the dedicated production line; and making the electric module by assembling the one or more electronic elements along a second stretch of the dedicated production line;

the making the casing and making the electric module being synchronized and independent relative to one another; and once the making the casing and making the electric module are complete, assembling the casing with the electric module along a shared third stretch of the dedicated production line.

2. The method according to claim 1, wherein the making the electric module further comprises feeding a basic component along the second stretch and assembling the one or more electronic elements to the basic component.

3. The method according to claim 2, and further comprising orienting the basic component according to a predetermined configuration and checking an orientation of the basic component relative to the predetermined configuration.

4. The method according to claim 2, and further comprising mounting the one or more electronic elements on the basic component according to predetermined mutual positions.

5. The method according to claim 1, and further comprising feeding an accessory component of the electric module along the second stretch and assembling the accessory component to the one or more electronic elements.

6. The method according to claim 5, and further comprising orienting at least one chosen from the one or more electronic elements and the accessory component before the feeding the accessory component.

7. The method according to claim 1, and further comprising wiring at least one of the one or more electronic elements to a further one of the one or more electronic elements.

8. The method according to claim 1, wherein the making the casing further comprises inserting the retaining and containing component into a shell.

9. The method according to claim 8, wherein the making the casing further comprises assembling the shell with a closing element.

10. The method according to claim 8, wherein the making the casing further comprises filling the retaining and containing component with the flavoring substance.

11. A machine for making a cartridge for an electronic cigarette, the cartridge comprising a casing housing a retaining and containing component for retaining and containing a flavoring substance and an electric module, at least partly positioned in the casing, the electric module comprising one or more electronic elements for heating the retaining and containing component;

the machine comprising:

a dedicated production line along which the cartridge is made;

the dedicated production line further comprising:

a first stretch along which the casing is made by assembling one or more components;

a second stretch along which the electric module is made by assembling the one or more electronic elements;

the first stretch and second stretch being synchronized and independent relative to one another; and a shared third stretch for assembling the casing with the electric module;

the shared third stretch connecting the first stretch and the second stretch.

* * * * *